United States Patent [19]

Hinz

[11] 4,020,973

[45] May 3, 1977

[54] APPARATUS FOR REMOVING ROD-SHAPED ARTICLES FROM A MAGAZINE

[75] Inventor: Werner Hinz, Hamburg, Germany

[73] Assignee: Hauni-Werke Korber & Co., KG, Hamburg, Germany

[22] Filed: Feb. 5, 1976

[21] Appl. No.: 655,548

[30] Foreign Application Priority Data

Feb. 13, 1975 Germany ..... 2505998

[52] U.S. Cl. ..... 221/13; 221/21

[51] Int. Cl.[2] ..... B65H 43/00

[58] Field of Search ..... 221/21, 266, 237, 14, 221/10, 13, 9; 53/148–151

[56] References Cited

UNITED STATES PATENTS

| | | | |
|---|---|---|---|
| 1,680,024 | 8/1928 | Koener | 221/21 |
| 2,762,180 | 9/1956 | Hall | 221/21 X |
| 3,206,065 | 9/1965 | Netta | 221/237 X |

*Primary Examiner*—Stanley H. Tollberg
*Attorney, Agent, or Firm*—Peter K. Kontler; John Kurucz

[57] ABSTRACT

Apparatus for removing filter rod sections from a magazine in a filter cigarette making machine. The magazine has an outlet which receives a portion of a fluted drum so that, when the drum rotates, its flutes remove filter rod sections from the magazine. A yieldably mounted refuser roller is disposed between the drum and the magazine at the downstream side of the outlet to normally prevent the drum from removing sections which are not received in the flutes. If a section adheres to a section in a flute and displaces the refuser roller against the opposition of a spring, the roller or a lever for the roller actuates a switch which disengages a clutch serving to transmit torque to the drum and to other moving parts of the machine.

10 Claims, 2 Drawing Figures

APPARATUS FOR REMOVING ROD-SHAPED ARTICLES FROM A MAGAZINE

BACKGROUND OF THE INVENTION

The present invention relates to apparatus for removing rod-shaped articles from magazines. More particularly, the invention relates to improvements in apparatus for removing rod-shaped articles from magazines in tobacco processing machines, e.g., from the magazine which forms part of a filter cigarette making machine. The commodities which can be manipulated in the apparatus of the present invention include plain or filter-tipped cigarettes, cigars or cigarillos, filter rod sections and/or any other rod-shaped articles which constitute or form part of smokers' products.

It is already known to store filter rod sections or analogous rod-shaped articles in a magazine wherein two walls flank an outlet disposed above a portion of a rotary drum-shaped conveyor whose flutes serve to remove articles from the magazine for further processing, for example, to remove filter rod sections from the magazine of a filter cigarette making machine wherein the sections are thereupon subdivided to yield shorter sections which are assembled with plain cigarettes to form filter cigarettes of unit length or multiple unit length. It is further customary to use in such machines a rotary refuser roller which is disposed between the conveyor and that wall of the magazine which is adjacent to the downstream end of the outlet. The purpose of the refuser roller is to prevent evacuation of those articles which are not received in the flutes of the conveyor as well as to reduce the likelihood of a pileup of articles in the region where successive flutes of the conveyor move beyond the outlet of the magazine. Articles which leave the magazine without being received in the flutes of the conveyor cannot be controlled and are likely to clog the machine, to be fragmentized and to thus contaminate the machine, to cause breakage or deformation of sensitive parts and/or to result in the making of unsatisfactory smokers' products. It has been found that filter rod sections are especially likely to clog the outlet of the magazine in a machine for the making of filter cigarettes, cigarillos or cigars. This is due to the fact that the surplus of adhesive paste which is used to form the seams of wrappers of filter rod sections is likely to remain active after the respective sections are introduced into the magazine, and such surplus tends to bond the wrappers of two or more neighboring sections to each other. If the bond between two or more neighboring filter rod sections is sufficiently strong, a section which is properly received in the flute of the aforementioned conveyor is likely to entrain one or more additional sections with the result that the additional section or sections are squashed during passage along the refuser roller and contaminate and/or otherwise affect the operation of the machine. Belated detection of improperly evacuated filter rod sections can result in substantial damage to and in greatly reduced output of the machine. Thus, it often takes a long period of time before the attendants detect an improperly evacuated filter rod section, especially if such section is permitted to advance into a portion of the machine which is not readily accessible or, if accessible, does not allow for rapid and convenient removal of improperly evacuated and transported sections.

While the aforementioned refuser roller normally prevents uncontrolled evacuation of rod-shaped articles which are not received in the flutes of the conveyor, such roller is not sufficiently reliable, especially under the aforediscussed circumstances when the surplus of adhesive paste on one or more sections of a filter rod bonds the respective section or sections to the wrappers of neighboring sections with a substantial force.

SUMMARY OF THE INVENTION

An object of the invention is to provide a novel and improved apparatus for removing rod-shaped articles (especially articles which constitute or form part of rod-shaped smokers' products) from a magazine in such a way that improper evacuation of one or more articles can be prevented or detected and appropriate action taken before the improperly evacuated article or articles can cause extensive damage and/or appreciable losses in output.

Another object of the invention is to provide a novel and improved mounting for the refuser at the downstream side of the outlet of a magazine for a supply of parallel rod-shaped articles, e.g., filter rod sections of multiple unit length, such as enables the refuser to initiate the performance of one or more steps toward rapid elimination of causes of improper evacuation of articles from the magazine and/or removal of improperly evacuated articles.

A further object of the invention is to provide an apparatus which can automatically arrest its moving parts and/or the moving parts in other sections of a tobacco processing machine in immediate or delayed response to detection of one or more articles which tend to leave the magazine in a manner other than that which is needed to insure unimpeded operation of the machine.

An additional object of the invention is to provide a tobacco or filter material processing machine which embodies the above outlined apparatus.

The invention is embodied in an apparatus for removing rod-shaped articles which constitute or form part of smokers' products from a magazine which contains a supply of parallel rod-shaped articles (e.g., filter rod sections of multiple unit length), which has an outlet for evacuation of articles, and which includes two walls flanking the outlet. The apparatus comprises a conveyor (e.g., a rotary drum) including a portion adjacent the outlet (the drum is preferably mounted at a level below the outlet) and a plurality of parallel article-receiving means (e.g., cradles or flutes provided at the priphery of the drum), means for driving the conveyor so that successive receiving means of the conveyor travel along the outlet in a direction toward and beyond one of the walls of the magazine, thereupon toward and beyond the other wall of the magazine and receive articles during travel between the walls (the driving means may comprise a normally engaged clutch which can receive torque from a main prime move, e.g., from the motor of a cigarette making machine which is directly coupled to the machine embodying the improved apparatus), a refuser (preferably a driven roller or an analogous rotary member) which is adjacent the outlet intermediate the conveyor and the other wall of the magazine and is positioned to prevent the conveyor from removing articles which are not received in the receiving means of the conveyor whereby the articles which tend to leave the magazine while not received in a receiving means of the conveyor exert a force against the refuser, and means (e.g., an electric switch which can be actuated to disengage the aforementioned clutch) for arresting the driving means in response to exertion of a predetermined force against the refuser.

In accordance with a presently preferred embodiment of the invention, the refuser is movable between a first position in which it prevents the conveyor from removing articles which are not received in receiving means and a second position in response to exertion of the aforementioned predetermined force. The arresting means is responsive to movement of the refuser to second position, e.g., such movement of the refuser can result in direct or indirect opening or closing of a microswitch which thereby arrests the driving means for the conveyor and preferably also for one or more conveyors which receive articles from the first mentioned conveyor. A spring or other suitable biasing means may be provided to yieldably urge the refuser to its first position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
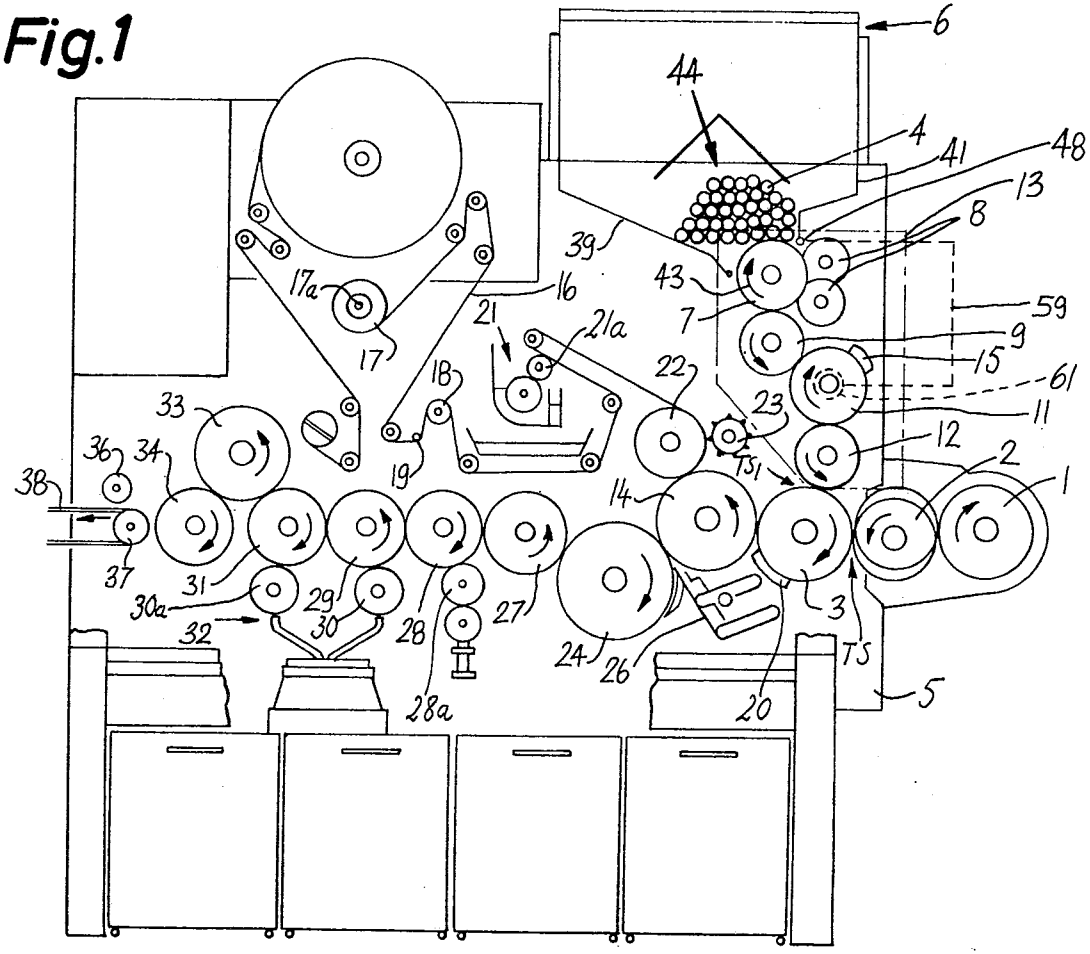
FIG. 1 is a schematic elevational view of a filter cigarette making machine including an apparatus which embodies the invention.

FIG. 1 shows a filter cigarette making machine of the type known as MAX-S which is produced by Hauni-Werke Korber & Co. KG, Hamburg-Bergedorf, Federal Republic Germany. The machine of FIG. 1 is directly coupled to a second machine (e.g., a machine known as GARANT and also produced by Hauni-Werke Korber & Co. KG) which makes plain cigarettes of unit length. The second machine or maker has a fluted rotary drum-shaped row-forming conveyor 1 which is mounted in the frame 5 of the filter cigarette making machine and delivers two rows of parallel plain cigarettes of unit length. The cigarettes of one row occupy the first, third, fifth, etc. flutes of the conveyor 1 and the cigarettes of the other row occupy the second, fourth, sixth, etc. flutes. Furthermore, the cigarettes of the one row are nearer to one axial end and the cigarettes of the other row are nearer to the other axial end of the conveyor 1. The frame 5 supports two fluted rotary drum-shaped aligning conveyors 2 one of which receives successive cigarettes of the one row and the other of which receives successive cigarettes of the other row. The aligning conveyors 2 are driven at different speeds and/or transport the cigarettes of the respective rows through different distances so that successive flutes of the conveyors 2 deliver pairs of aligned plain cigarettes of unit length into successive flutes of a rotary drum-shaped assembly conveyor 3. The transfer of successive pairs of aligned plain cigarettes of unit length into the flutes of the assembly conveyor 3 takes place at a station TS. The plain cigarettes of each pair are spaced apart from each other so as to define a gap having a width which at least equals the length of a filter rod section or plug of double unit length.

The upper portion of the frame 5 supports a magazine or hopper 6 which can be said to form part of the improved apparatus and contains a supply of parallel filter rod sections 4 of six times unit length. The outlet 44 in the bottom part of the magazine 6 receives a portion of a fluted rotary drum-shaped severing conveyor 7 which removes filter rod sections 4 from the magazine 6 and transports them in the direction indicated by arrow 43. Filter rod sections 4 in successive flutes of the conveyor 7 are severed by two rotary disk-shaped knives 8 so that each thereof yields a set of three coaxial filter rod sections or plugs of double unit length. The filter plugs of successive sets are accepted by discrete fluted rotary drum-shaped conveyors of a staggering device 9 (only one conveyor of the staggering device 9 is shown in FIG. 1). The conveyors of the staggering device 9 are driven to rotate at different speeds and/or transport the respective filter plugs through different distances so that the plugs of each set are staggered in the circumferential direction of the device 9. The thus staggered filter plugs are introduced into successive flutes of a rotary drum-shaped shuffling conveyor 11 which cooperates with stationary cams 15 to shift some or all of the filter plugs axially in order to form a single row wherein each preceding filter plug is accurately alined with the next-following plug. Successive filter plugs of the thus obtained single row are transferred into successive flutes of a rotary drum-shaped accelerating conveyor 12 which inserts successive filter plugs into those portions of successive flutes of the assembly conveyor 3 which are intended to be disposed between pairs of plain cigarettes. The transfer of filter plugs into the flutes of the assembly conveyor 3 takes place at the station $TS_1$. The filter plugs then advance toward the station TS and each thereof forms with the respective pair of plain cigarettes (delivered by the aligning conveyors 2) a group of three coaxial articles including a centrally located filter plug of double unit length and two plain cigarettes of unit length which are at least slightly spaced apart from the respective ends of the filter plug. Such groups are caused to advance between two condensing cams 20 (only one shown) which move oncoming plain cigarettes into abutment with the adjacent ends of the respective plug. The thus condensed or shortened groups are transferred into successive flutes of a rotary drum-shaped transfer conveyor 14.

The conveyor 7, the knives 8, the staggering device 9, and the conveyors 11, 12 together constitute a filter plug forming unit 13 (indicated by phantom lines) which converts filter rod sections 4 of 6 times unit length into filter plugs of double unit length and delivers such filter plugs to the flutes of the assembly conveyor 3. The conveyors 7, 9, 11, 12 of the unit 13 are driven in synchronism to insure predictable transfer of filter plugs into the flutes of the assembly conveyor 3.

The frame 5 of the filter cigarette making machine further supports a spindle **17*a* for a roll 17 of convoluted web 16 which may consist of cigarette paper, imitation cork or other material suitable to yield discrete uniting bands for connection of filter plugs to neighboring plain cigarettes. The web 16 is trained over several guide rollers and travels along and is flexed by the relatively sharp edge of a so-called curler 19 which promotes curling of the web and equalizes tensional stresses in the material of the web. Reference may be had to the commonly owned copending application Ser. No. 504,757 of Alfred Hinzmann filed Sept. 10, 1974 now U.S. Pat. No. 3,962,957 granted June 15, 1976. The thus treated web thereupon travels about a portion of a further guide roller 18 and one of its sides is coated with suitable adhesive paste during travel past the rotary applicator 21***a* of a paster 21. The leader of the web 16 is attracted to the periphery of a rotary suction drum 22 which cooperates with a rotary knife 23 having one or more blades which sever the leader of the web at regular intervals so that the web yields a succession of discrete adhesive-coated uniting bands. Successive uniting bands are attached to successive groups of rod-shaped articles in the flutes of the transfer conveyor 14 in such a way that each uniting band extends tangentially of the respective group and adheres to the filter plug as well as to the adjacent inner end portions of the corresponding plain cigarettes.

The conveyor 14 transfers successive groups (each of which carries a uniting band) onto a rotary drum-shaped wrapping conveyor 24 which cooperates with a rolling device 26 to convolute the uniting bands around the respective filter plugs and the adjacent end portions of aligned plain cigarettes so that each such group forms a filter cigarette of double unit length. Successive filter cigarettes of double unit length are transferred into successive flutes of a rotary drum-shaped drying conveyor 27 which, in turn, transfers successive cigarettes into successive flutes of a rotary drum-shaped severing conveyor 28 cooperating with a rotary disk-shaped knife 28*a* to subdivide each filter cigarette of double unit length into two aligned filter cigarettes of unit length. The conveyor 28 may form part of a testing device which segregates filter cigarettes of double unit length having defective wrappers from satisfactory cigarettes. Successive cigarettes of one row of the two rows of filter cigarettes of unit length which leave the conveyor 28 are inverted through 180° by a turn-around device 32 which includes drums 29, 30, 30*a* and 31 and places inverted filter cigarettes into the spaces between the non-inverted filter cigarettes of the other row so that all filter cigarettes of unit length form a single row wherein the filter plugs (of unit length) face in the same direction. A turn-around device which can be used in the filter cigarette making machine of FIG. 1 is disclosed in the commonly owned U.S. Pat. No. 3,583,546 to Koop.

The filter cigarettes of the thus obtained single row are transferred onto a further rotary drum-shaped conveyor 33 which forms part of a device for testing the quality of tobacco-containing ends of successive filter cigarettes and segregates cigarettes with defective ends from satisfactory cigarettes, either during travel with the conveyor 33 or during travel with the next-following rotary drum-shaped conveyor 34. Satisfactory filter cigarettes of unit length are transferred onto the upper reach of an endless belt conveyor 38 which is trained over two rollers 37 (one shown) and serves to deliver such filter cigarettes to storage or directly to a packing machine. The illustrated roller 37 cooperates with a rotary braking drum 36.

Figure 2:
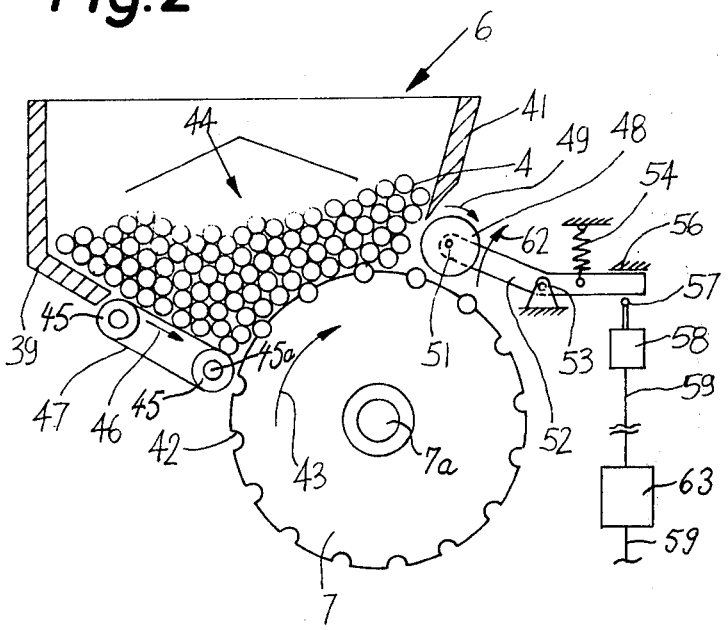
FIG. 2 is an enlarged fragmentary partly elevational and partly vertical sectional view of the apparatus.

FIG. 2 shows certain details of the improved apparatus. The magazine 6 has two convergent side walls 39, 41 which flank the outlet 44 for delivery of filter rod sections 4 to the upper portion of the severing conveyor 7. The latter is normally driven at a constant speed (arrow 43) and has a set of equidistant receiving means or flutes 42 each of which is parallel to the axis of the driving shaft 7*a* for the conveyor 7. A portion of the side wall 39 is movable; this portion includes an endless belt or band 47 which is trained over pulleys 45 one of which is driven by a shaft 45*a* to move the band 47 in the direction indicated by arrow 46. It will be noted that the side wall 39 including the band 47 is located at the upstream side of the outlet 44, as considered in the direction of rotation of the conveyor 7.

The lowermost portion of the side wall 41 is spaced apart from the periphery of the conveyor 7 to define therewith a clearance which receives a rotary refuser member here shown as a roller 48 which is driven by a shaft 51 to rotate in a clockwise direction (arrow 49), as viewed in FIG. 2. The shaft 41 is mounted on one arm of a carrier 52 here shown as a two-armed lever which is pivotable on a fixed pin 53 and the other arm of which is biased upwardly, as viewed in FIG. 2, by a helical spring 54 tending to maintain the other arm of the carrier 52 in abutment with a fixed stop 56. The other arm of the carrier 52 constitutes the trip for the upwardly biased movable portion 57 of an electric arresting switch 58 (e.g., a microswitch) which can be actuated to disengage a clutch 61 (FIG. 1) constituting a prime mover for all or some moving parts of the filter cigarette making machine. The operative connection between the switch 58 and the clutch 61 is indicated by a broken line 59. When the clutch 61 is engaged, it transmits torque to the conveyor 11 which, in turn, transmits motion to other moving parts of the filter cigarette making machine by way of gear trains and/or other suitable motion transmitting devices, not shown. Thus, when the clutch 61 is disengaged in response to pivoting of the righthand arm of the carrier 52 away from the stop 56, the moving parts of the filter cigarette making machine are arrested, either immediately or with a certain delay, e.g., with an adjustable delay determined by the setting of a suitable time-delay device 63 forming part of the operative connection 59. Alternatively, the clutch 61 may transmit torque only to the aforementioned component parts 7, 8, 9, 11 and 12 of the filter plug forming unit 13. Such mode of operation is preferred at this time; however, and as explained above, it is within the purview of the invention to utilize the switch 58 as a means for arresting some or all moving parts of the filter cigarette making machine when the angular position of the carrier 52 changes. Such position of the carrier 52 will change when the roller 48 is lifted, as viewed in FIG. 2, by one or more filter rod sections which tend to leave the magazine 6 along the periphery of the conveyor 7 rather than while received in a flute 42.

When the filter cigarette making machine is in use, the conveyor 7 is driven by the clutch 61 at a given speed so that it rotates in the direction indicated by arrow 43. The shaft 45*a* for the right-hand pulley 45 drives the band 47 at a speed which equals or exceeds the peripheral speed of the conveyor 7. This enables the upper reach of the band 47 to roll and agitate the adjacent filter rod sections 4 at the upstream end of the outlet 44 so that the band 47 prevents bridging of filter rod section and insures that each oncoming flute 42 of the conveyor 7 receives a discrete section 4. The agitating action of the band 47 is felt in several layers of filter rod sections 4 adjacent the side wall 39. Moreover, the upper reach of the band 47 "aims" the adjacent sections 4 toward and into the flutes 42 which travel along the outlet 44; this further insures that each flute 42 receives a section 4 before it reaches the refuser roller 48. As a rule, the band 47 insures that an oncoming flute 42 receives a filter rod section 4 as soon as it moves at least slightly beyond the right-hand pulley 45.

It will be noted that the shaft 51 drives the refuser roller 48 in a clockwise direction, i.e., counter to the direction of rotation of the conveyor 7. This, combined with suitable positioning of the stop 56, insures that the roller 48 prevents escape of those sections 4 from the magazine 6 which are not received in the flutes 42 of the conveyor 7. Moreover, the refuser roller 48 prevents a pile-up and jamming of filter rod sections 4 at the downstream end of the outlet 44; such action of the roller 48 is attributed to the fact that it rotates counter to the direction of rotation of the conveyor 7 and that it is mounted at the downstream end of the outlet 44.

If a filter rod section 4 happens to adhere to a filter rod section in one of the flutes 42, e.g., because the adhesive paste in the seam of the wrapper forming part of a first filter rod section adheres to the wrapper of the neighboring filter rod section (which is received in a flute 42), the roller 48 is lifted (arrow 62) by moving from the illustrated first position to a second position against the opposition of the spring 54, i.e., the carrier 52 is pivoted clockwise, as viewed in FIG. 2, and its right-hand arm engages and depresses the movable portion 57 of the arresting switch 58. The latter disengages the clutch 61, either immediately or with a delay which is determined by setting of the time-delay device 63, whereby the clutch 61 causes stoppage of all moving parts of the filter plug forming unit 13. In the absence of a time-delay device, the parts of the unit 13 are arrested practically instantaneously so that the filter rod section or sections 4 which are wedged between the periphery of the conveyor 7 and the refuser roller 48 are within reach for removal by hand. FIG. 1 shows that the region of the refuser roller 48 is readily accessible so that removal of one or more filter rod sections at this locus consumes little time.

If the switch 58 does not serve as a part of or as the means for arresting the entire filter cigarette making machine, the arrangement is preferably such that opening (or closing, as the case may be) of this switch by the carrier 52 results in immediate or delayed stoppage of the unit 13 and in stoppage of the paster 21. When the cause of malfunction (i.e., one or more filter rods 4 which have caused the carrier 52 to pivot clockwise) is removed, the unit 13 is preferably started at least slightly ahead of the paster 21. The means for effecting such delayed starting of the paster 21 in response to starting of the unit 13 will be readily conceived by those having average skill in the art.

It will be noted that the refuser roller 48 responds to the exertion of a predetermined force (furnished by one or more filter rod sections 4 which tend to leave the magazine 6 while not received in the flutes 42) to thereby cause stoppage of the conveyor 7 (and preferably one or more additional conveyors) by way of the arresting switch 58. When the roller 48 is subjected to the action of the pedetermined force, it moves from the illustrated first position to the aforementioned second position whereby such movement through a given distance suffices to result in actuation of the arresting switch 58. As a rule, such predetermined force is furnished by one or more sections 4 which merely contact the periphery of the conveyor 7 and tend to escape between this conveyor and the roller 48.

An important advantage of the improved apparatus is that the refuser roller 48 can immediately react to each and every deviation from normal transport of rod-shaped articles from the magazine 6 and can interrupt such transport, either immediately or with a requisite delay, in order to enable an attendant to rapidly remove the cause or causes of malfunction. This is particularly important in a modern high-speed tobacco processing machine. As a rule, the roller 48 can effect a stoppage of the unit 13 in such a way that the cause of malfunction (e.g., a rod 4 which adheres to the neighboring rod or rods) remains at the very locus where the malfunction occurred. This reduces the likelihood of damage to other parts of the machine, e.g., breakage of gears which drive the moving parts of the unit 13, squashing of one or more sections 4 and resulting contamination of the machine, production of a large number of defective filter cigarettes and/or others. The elimination of malfunctions which would occur if one or more sections 4 were permitted to leave the magazine 6 in a manner other than while received in the flutes 42 of the conveyor 7 and to advance beyond the conveyor 7 would require much more time and effort than the removal of one or more filter rod sections in the region of the refuser roller 48.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed is:

1. Apparatus for removing rod-shaped articles which constitute or form part of smokers' products from a magazine which contains a supply of parallel rod-shaped articles, which has an outlet for evacuation of articles and which includes two walls flanking said outlet, comprising a conveyor including a portion adjacent said outlet and a plurality of parallel article-receiving means; means for driving said conveyor so that successive receiving means travel along said outlet in a direction toward and beyond one of said walls, thereupon toward and beyond the other of said walls and receive articles during travel between said walls; a refuser adjacent said outlet intermediate said conveyor and said other wall, said refuser being positioned to prevent said conveyor from removing articles which are not received in said receiving means whereby the articles which tend to leave said magazine while not received in a receiving means of said conveyor exert a force against said refuser; and means for arresting said driving means in response to exertion of a predetermined force against said refuser.

2. Apparatus as defined in claim 1, wherein said conveyor is a rotary drum which is disposed below said magazine and said receiving means are flutes in the periphery of said drum.

3. Apparatus as defined in claim 1, wherein said refuser is a rotary member.

4. Apparatus as defined in claim 1, wherein said refuser is movable between a first position in which it prevents said conveyor from removing articles which are not received in said receiving means and a second position in response to exertion of said predetermined force, said arresting means being responsive to movement of said refuser to said second position.

5. Apparatus as defined in claim 4, further comprising means for yieldably biasing said refuser to said first position.

6. Apparatus as defined in claim 5, further comprising a carrier pivotable about a fixed axis and supporting said refuser for movement between said first and second positions, said biasing means comprising a spring urging said carrier in a direction to maintain said refuser in said first position.

7. Apparatus as defined in claim 1, wherein said refuser is movable to and from a position in which it prevents said conveyor from removing articles which are not received in said receiving means and leaves said position in response to exertion of said predetermined force, said arresting means being responsive to a predetermined movement of said refuser from said position.

8. Apparatus as defined in claim 1, wherein said arresting means comprises an electric switch.

9. Apparatus as defined in claim 1, wherein said driving means comprises a clutch and said arresting means comprises a device for disengaging said clutch in response to exertion of said predetermined force.

10. Apparatus as defined in claim 1, further comprising at least one second conveyor arranged to receive articles from the receiving means of said first mentioned conveyor, said driving means including means for moving said second conveyor in synchronism with said first mentioned conveyor.

* * * * *